United States Patent [19]

Fair et al.

[11] 3,966,912

[45] June 29, 1976

[54] METHOD OF PREPARING TOBACCO SMOKE FILTER

[75] Inventors: Graeme David Fair, Toorak; Derek Lesley Arthur Hasmall, West Brunswick; William Patrick Ryan, Lugarno; Edwin John Sellman, Burwood, all of Australia

[73] Assignees: Rothmans of Pall Mall (Australia) Limited, Granville; Lantor of Australia Pty. Ltd., Sydney, both of Australia

[22] Filed: Aug. 1, 1975

[21] Appl. No.: 601,136

Related U.S. Application Data

[62] Division of Ser. No. 399,306, Sept. 21, 1973, abandoned.

[52] U.S. Cl. ..... 264/118; 131/267; 264/119; 264/128; 264/287

[51] Int. Cl.[2] ..... B29D 23/10

[58] Field of Search ..... 264/118, 119, 128, 136, 264/137, 287; 131/266, 267

[56] References Cited

UNITED STATES PATENTS

| | | | |
|---|---|---|---|
| 2,001,709 | 5/1935 | Davidson | 264/287 X |
| 2,464,301 | 3/1949 | Francis | 264/119 X |
| 3,137,589 | 6/1964 | Reinhard | 117/240 |
| 3,180,911 | 4/1965 | Muller | 264/119 |
| 3,238,852 | 3/1966 | Schur | 131/266 |
| 3,268,084 | 8/1966 | Allman | 131/267 X |
| 3,461,882 | 8/1969 | Epstein | 131/262 B |
| 3,494,263 | 2/1970 | Tachibana | 264/128 X |
| 3,849,526 | 11/1974 | Muller | 264/287 X |

FOREIGN PATENTS OR APPLICATIONS

| | | | |
|---|---|---|---|
| 757,841 | 1956 | United Kingdom | 131/266 |

*Primary Examiner*—Richard R. Kucia
*Attorney, Agent, or Firm*—Wenderoth, Lind & Ponack

[57] ABSTRACT

A tobacco smoke filter element for use in cigarettes, cigarette holders, cigar holders or pipes is formed from a bonded non-woven fabric composed wholly or partly of wool fibers. It is preferred that the content of wool fibers shall be as high as is economically feasible. It is preferred that in the case of a filter for a cigarette the filter is made by converting a web of bonded non-woven fabric to a filter rod of substantially circular cross-section.

9 Claims, 5 Drawing Figures

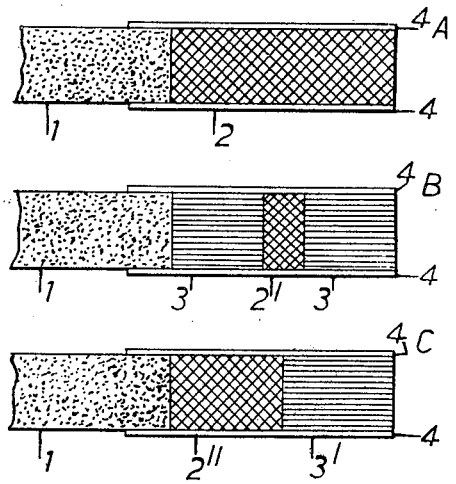
FIG.2.
FIG.3.
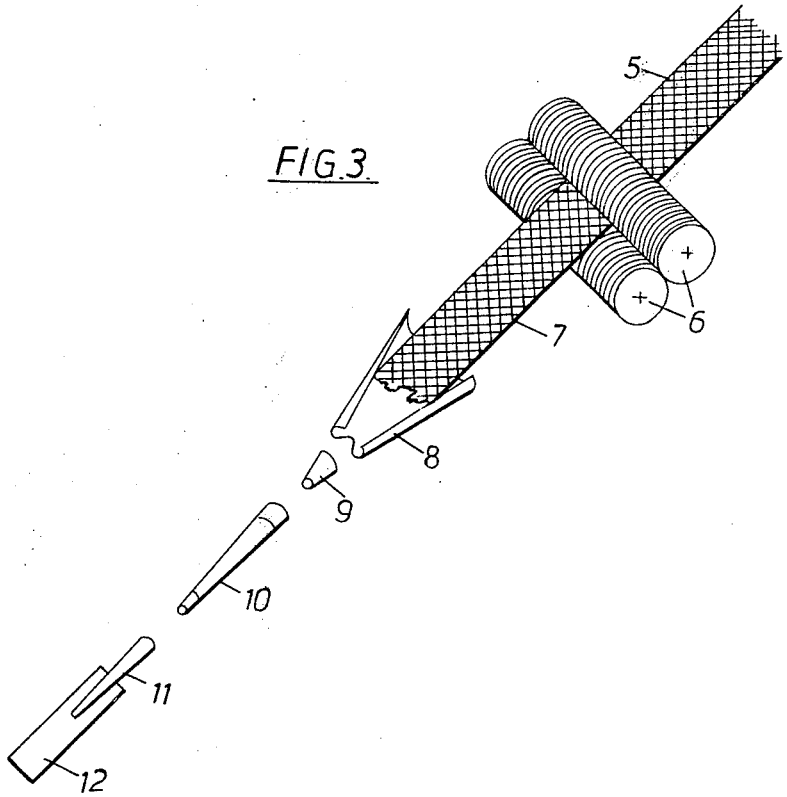

METHOD OF PREPARING TOBACCO SMOKE FILTER

This is a division of application Ser. No. 399,306, filed Sept. 21, 1973, and now abandoned.

BACKGROUND OF THE INVENTION

This invention relates to the production of tobacco smoke filter elements of the kind (hereinafter referred to as the kind set forth) intended for incorporation in cigarettes, cigarette holders, cigar holders or pipes.

It has been found that wool fibres have certain specific advantages, which are described below, which make them very suitable for use in connection with tobacco smoke filter elements, particularly such elements for use in cigarettes. However the manufacture of cigarettes is a highly automated high speed procedure and substantial difficulties are encountered in producing wool fibres in a form compatible with such manufacture. The principal object of the present invention is to provide a solution to this problem.

SUMMARY OF THE INVENTION

This invention consists in producing a tobacco smoke filter element of the kind set forth from a bonded non-woven fabric composed wholly or partly of wool fibres.

The first step in the preparation of a filter element according to the invention is to manufacture a non-woven fabric composed wholly or partly of wool fibres.

The technique to be used in the present invention is dry web formation by the random lay method using external bonding by saturation with a suitable polymeric binder, e.g. polyacrylate, acrylonitrite-butadiene, styrenebutadiene, either alone or in admixtures.

There is no limitation on the variety of wool types which may be used to prepare the fabric although the characteristics of the fabric and hence the filter will be influenced by the wool type and consequently a preferred wool type is Merino lamb's wool with a 1–1½ inch staple length and a fibre diameter averaging from 18–22 microns.

Pre-treatment of the wool fibres prior to formation of the non-woven fabric is similar to that normally given to wool prior to high quality textile production, namely scouring, carbonizing and carding, except that an additional step of fully bleaching either by perborate or peroxide methods, but preferably the latter is desirable.

Up to 25% synthetic or natural fibres other than wool, e.g. cellulose acetate, cellulose, reconstituted cellulose, polyolefines, PVC-PVA, polyamides e.g. nylon and synthetic linear polyesters such as that derived from terephthalic acid and ethylene glycol may be included to improve strength of the non-woven fabric if required.

Much larger percentage inclusions of synthetic or other natural fibres may be desirable for economic reasons, according to the ruling market price for wool, or for aesthetic reasons, according to the extent of colour in the available wool fibres. However, as might be expected, the advantageous characteristics of filters due to the proportion of wool fibres made from wool-synthetic blends tend to lessen to a degree directly proportional to the inclusion of synthetic fibres in comparison with a pure wool filter.

BRIEF DESCRIPTION OF THE DRAWINGS

In order that the nature of the invention may be better understood and put into practice preferred forms thereof are hereinafter described, by way of example, with reference to the accompanying drawings in which:

FIG. 3 illustrates diagrammatically the manner in which a strip of bonded non-woven woolen fabric may be formed into smoke filter elements for cigarettes.

DETAILED DESCRIPTION OF THE INVENTION

Figure 1:
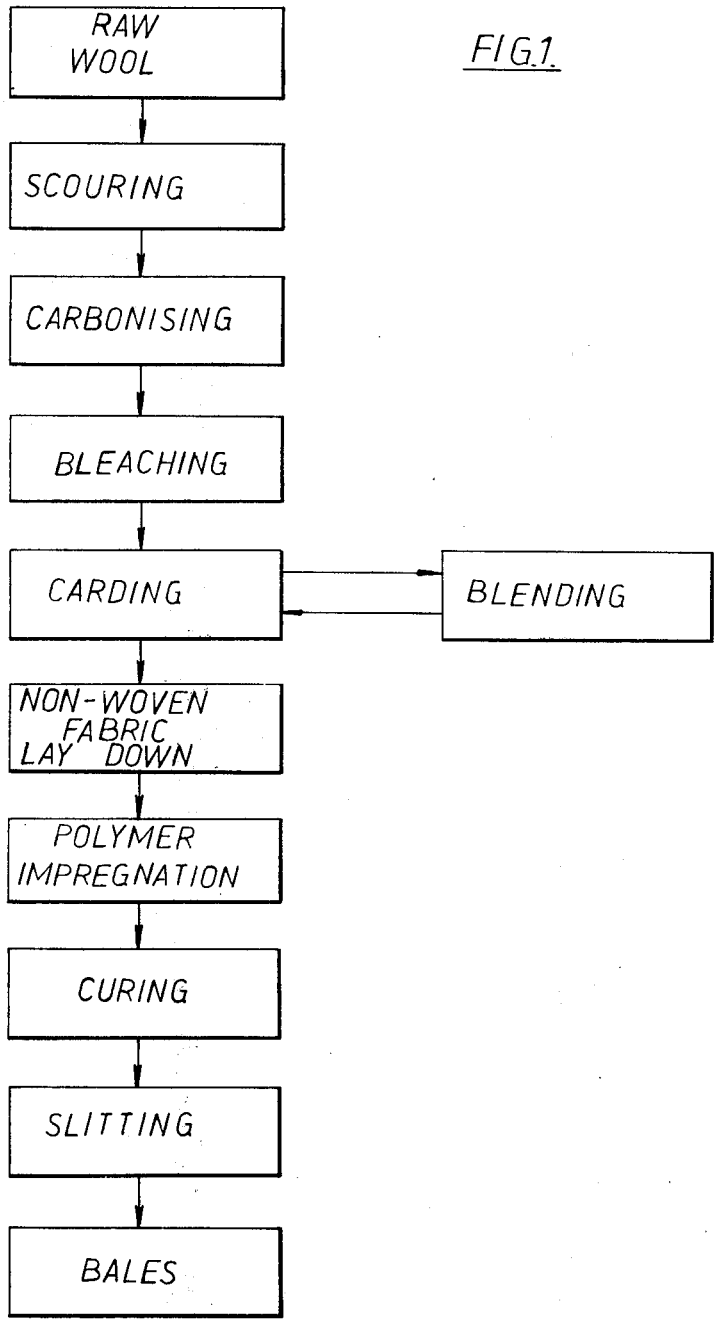
FIG. 1 is a diagram illustrating schematically the procedure for the preparation of a suitable bonded non-woven woolen fabric, FIGS. 2A, B and C illustrate three possible ways in which a filter according to the invention may be incorporated in a cigarette

A typical procedure for preparation of the bonded non-woven woolen fabric is illustrated schematically in FIG. 1 and is described as follows:

The wool fibre which has been previously scoured, carbonized and bleached, is opened and cleaned by a conventional woolen carding machine prior to blending and feeding to the web forming machine which lays down the web pneumatically, preferably in a random fashion. The continuous dry web is passed to and immersed in a bath of a synthetic latex polymer acrylonitrile-butadiene, incorporating an appropriate hardener such as melamine formaldehyde to promote cross linking of the polymer. After removal of excess polymer the coated web is passed through a heating tunnel operated at 250°–350°F (dependent on the speed of throughput) to promote drying and cross linking or curing of the polymer, the net effect being that the fibre web is bonded at the fibre-fibre intersections. The width of the web depends on the web forming machine used and may be, for example, 60 inches. Various thickness webs can be formed but for manufacture of continuous filter rods a web weight of 2 ozs. per square yard is the preferred thickness.

To prepare the non-woven woolen fabric for filter rod manufacture the web is slit to smaller appropriate widths dependent on the characteristics required in the filter rod, such as diameter, pressure drop and hardness, but a typical width is 5 inches. Slitting may take place at the end of the non-woven machine to give continuous strips of, in effect, infinite length or if desired the full width fabric may be wound on to a "jumbo" reel for slitting in a separate operation at some later stage.

The next step in the manufacture of the filter element is to convert the strip of non-woven fabric to a filter rod of substantially circular cross section.

Preparation of filter rods from the appropriate width strips of non-woven fabric can be accomplished on conventional filter rod manufacturing machines. However, before entering the garniture of such a machine it has been found desirable to modify the physical characteristics of the fabric to assist rod formation and this is illustrated in FIG. 3. The non-woven wool fabric 5 is passed through heated corrugated rolls 6, which heat and impart a quasi-corrugation in the longitudinal direction to the fabric 7, the object being to assist folding and compression during rod formation and thence through a pre-folder 8 followed by a trumpet 9, and a heated condensing tube 10, before entering the tongue piece 11 of the garniture 12 for rod formation and enclosure in plug wrap paper in the conventional manner. The pre-folder 8 is so designed to convert the strip of non-woven fabric to a cylindrical rod in a progressive and uniform manner. The pre-folder may take a variety of different forms but in the form illustrated the pre-folder is shaped so that the edges of the strip are turned upward and over towards the centre of the strip while the centre of the strip is raised and folded, the fold caused to protrude in the same upward direction. The strip in this configuration is gradually compressed towards the circular form, the final formation of the rod being carried out in the heated condensing tube 10 which is heated to a temperature preferably of about 150°F.

Although increasing the moisture content of wool above its equilibrium level does assist in rod formation, a level of between 5–20% has been found adequate.

Although the corrugated rolls can have a variety of parameters and combinations of parameters which would successfully achieve the effect of longitudinally corrugating and increasing the temperature of the wool fabric, typical operating conditions which have been found to be effective are rolls 12 inches in width and 8 inches in diameter with 25 corrugations per inch with a depth of 0.045 inches, operated at a temperature of 225°F at a linear speed of 195 ft/min. with a "nip" pressure of 5–7 p.s.i. Although neither some or any of the above modifications are essential for rod formation, they are highly desirable to render the wool fabric more conformable and allow the production of filter rods with minimal dimensional variability. Filter rods so formed are suitable for incorporation in cigarettes on conventional assembly machinery with further treatment.

If desired, wool filters can be achieved without conventional filter rod manufacture by punching discs of wool from a heavier weight fabric, e.g. 6–15 oz./sq.yd., and using inserters to interpose the discs between conventional filters made from cellulose acetate or paper.

FIG. 2 illustrates three examples of how a wool filter may be incorporated in a cigarette. FIG. 2A shows a total wool filter 2 attached to the tobacco rod portion of a cigarette 1, the attachment being achieved by tipping paper 4 in the conventional manner.

FIG. 2B shows a wool filter in the form of a disc of heavier weight non-woven wool fabric 2' enclosed between conventional cellulose acetate filters 3, and FIG. 2C shows a wool filter 2'' incorporated as an inner filter next to the tobacco rod portion 1 of the cigarette, a conventional cellulose acetate filter 3' being the outer filter at the end of the mouth piece.

Tobacco smoke filter elements prepared from a bonded non-woven substantially woolen fabric have distinct advantages over conventional filters in that they:

1. Retain the major portion of their initial hardness during smoking, unlike conventional cigarette filters, e.g. cellulose acetate, which tend to soften and collapse on smoking. This is largely due to the volumetric expansion of the wool fibres accompanying the adsorption of water from the tobacco smoke during smoking as well as the high degree of fibre randomization giving a significant proportion of the fibres aligned in the transverse direction.

2. Provide a highly dsirable balance in the "tar" and nicotine filtration efficiency, which can be observed by the smoker, to give the smoke a "smoother" taste.

Table 1 gives a typical example of this:

TABLE I

| | Filtration Efficiency % | |
|---|---|---|
| Filter Type | "Tar" (dry TPM) | Nicotine |
| Wool | 38.3 | 38.6 |
| Cellulose Acetate (3.3(1)/39000 | 33.6 | 31.5 |

3. Have a significantly higher filtration efficiency for "tar" and nicotine than cellulose acetate filters of equivalent dimensions and pressure drop.

This is illustrated in Table 1 which shows the comparative filtration efficiencies of 20mm long. 7.8mm diameter wool and cellulose acetate filters, both with a mean pressure drop of 6.3cm W.G. The improved filtration coefficient (filtration efficiency-pressure drop ratio) of wool filters is comparable to that of conventional paper filters but without their adverse taste and aesthetic characteristics.

4. Incorporate a raw material which has a relatively high degree of chemical reactivity which renders it capable of adsorption of some gas phase components from the tobacco smoke. This reactivity is due to the keratin (protein) composition of wool and its reactive side chains, particularly the —CO— and —NH— cross-linkages. Although the full extent of the chemical reactivity of wool as it relates to tobacco smoke has yet to be elucidated, the permanent discolouration of a wool filter even after solvent extraction of the tobacco smoke condensate is adequate evidence of irreversible chemical reactions having occurred.

The invention also envisages provision of a filter in, for example, a cigarette holder so that cigarettes not incorporating filters according to the invention could be smoked by inserting the filter in the holder, then the cigarette in the holder and the filter being arranged so that the smoke from the cigarette passes through the filter before being drawn into the user's mouth. A similar arrangement can be used in connection with a pipe.

We claim:

1. A method of making a tobacco smoke filter element, said method comprising:

forming a dry web of bonded non-woven fabric at least partly from scoured, carbonized and bleached wool fibres by the random lay method;

immersing the said dry web in a bath of a polymeric binder;

drying and curing said polymeric binder;

slitting said web to form strips of a predetermined width;

passing each said strip through heated corrugated rolls thereby heating and imparting to said strip a quasi-corrugation in the longitudinal direction thereof; and feeding each strip to the garniture of a conventional filter rod manufacturing machine to form a filter element.

2. A method as claimed in claim 1, further comprising passing said strip through a prefolder which is shaped so that the edges of the strip are turned upward and over towards the center of the strip while the center of the strip is raised and folded, the fold being caused to protrude in the same upward direction.

3. A method as claimed in claim 1, wherein said filter element is formed as a rod-shaped body of substantially circular cross-section.

4. A method as claimed in claim 1, wherein said non-woven fabric is at least 75% wool fibres, the remainder consisting of fibres other than wool.

5. A method as claimed in claim 4, wherein said remainder comprises fibres selected from the group consisting of cellulose acetate, cellulose, reconstituted cellulose, polyolefines, PVC-PVA and polyamides.

6. A method as claimed in claim 1, wherein said non-woven fabric is composed substantially wholly of wool fibres.

7. A method as claimed in claim 1, wherein said polymeric binder is selected from the group consisting of polyacrylate, acrylonitrile-butadiene and styrene-butadiene.

8. A method as claimed in claim 1, wherein said wool fibres are merino lamb's wool with a 1–1½ inch staple length and a fibre diameter averaging from 18 to 22 microns.

9. A method as claimed in claim 1, wherein said bonded non-woven fabric web has a web weight of approximately two ounces per square yard.

* * * * *